US005799777A

United States Patent [19]

Mailliet et al.

[11] Patent Number: 5,799,777

[45] Date of Patent: Sep. 1, 1998

[54] DEVICE FOR THE DISTRIBUTION OF MATERIALS IN BULK

[75] Inventors: Pierre Mailliet; Emile Lonardi; Gilbert Bernard, all of Grand Duchy, Luxembourg

[73] Assignee: Paul Wurth S.A., Luxembourg

[21] Appl. No.: 682,771

[22] PCT Filed: Jan. 9, 1995

[86] PCT No.: PCT/EP95/00060

§ 371 Date: Oct. 1, 1996

§ 102(e) Date: Oct. 1, 1996

[87] PCT Pub. No.: WO95/21272

PCT Pub. Date: Aug. 10, 1995

[30] Foreign Application Priority Data

Feb. 1, 1994 [LU] Luxembourg ..... 88 456

[51] Int. Cl.[6] ..... B65G 31/04

[52] U.S. Cl. ..... 198/642; 414/208; 414/301

[58] Field of Search ..... 198/638, 641, 198/642; 414/195, 198, 199, 204, 205, 208, 301, 302

[56] References Cited

U.S. PATENT DOCUMENTS

| | | | |
|---|---|---|---|
| 2,859,862 | 11/1958 | Best | 198/642 |
| 3,206,044 | 9/1965 | Schwichtenberg | 198/642 |
| 3,682,394 | 8/1972 | Shivvers | 414/301 X |
| 3,766,868 | 10/1973 | Mahr . | |
| 3,814,403 | 6/1974 | Legille . | |
| 4,316,681 | 2/1982 | Sida | 414/301 X |
| 4,360,305 | 11/1982 | Dorsch | 414/208 |
| 4,368,813 | 1/1983 | Mailliet . | |
| 4,395,182 | 7/1983 | Suwyn | 414/301 X |
| 4,941,792 | 7/1990 | Cimenti et al. . | |
| 5,002,806 | 3/1991 | Chung . | |
| 5,022,806 | 6/1991 | Lonardi et al. . | |
| 5,299,900 | 4/1994 | Maillet et al. | 414/208 X |

FOREIGN PATENT DOCUMENTS

| | | |
|---|---|---|
| 2636726 | 3/1990 | France . |
| 2649248 | 5/1978 | Germany . |
| 1392111 | 1/1989 | U.S.S.R. . |

*Primary Examiner*—James R. Bidwell

*Attorney, Agent, or Firm*—Fishman, Dionne, Cantor & Colburn

[57] ABSTRACT

A device for the distribution of materials in bulk comprises a chute (10) suspended from a first rotor (18) so as to be driven in rotation and to be capable of pivoting about a pivoting axis (33). A pivoting ring (38) is connected to the chute (10) so as to be capable of pivoting about an axis (36) perpendicular to the horizontal pivoting axis (33) of the chute (10). A guide means, preferably comprising a large diameter suspension bearing (52), is supported by a second rotor (40). It defines for the pivoting ring (38), in a reference frame attached to the second rotor (40), an inclined plane of rotation which makes an angle α with a horizontal reference plane. The pivoting ring (33) creates, during a relative rotation in this inclined plane of rotation, a pivoting of the chute (10) about the pivoting axis (33).

11 Claims, 2 Drawing Sheets

DEVICE FOR THE DISTRIBUTION OF MATERIALS IN BULK

The present invention relates to a device for the distribution of materials in bulk using a revolving chute with a variable angle of inclination. More particularly, it relates to a device for the distribution of materials in bulk comprising a delivery chute for materials in bulk, a first rotor with a substantially vertical rotation axis, the chute being suspended from the said first rotor so as to be able to pivot around a substantially horizontal pivoting axis; and a second rotor with a rotation axis substantially coaxial with the said first rotor.

Such devices for the distribution of materials in bulk are used for example in charging devices for shaft furnaces, particularly blast furnaces. The chute then provides for the distribution of the charging material over the surface of the charge inside the shaft furnace.

In the device described in the preamble, the first rotor essentially imposes a rotation on the chute about a vertical axis. The second rotor interacts with the chute in such a way as to determine its angle of inclination with respect to the vertical. For this purpose, the second rotor is connected to the chute by a pivoting mechanism transforming a variation in the angular offset between the two rotors into a variation in the angle of inclination of the chute in its vertical pivoting plane.

Different variants in implementation have been proposed for this pivoting mechanism, which generates the moment necessary to pivot the chute around its horizontal pivoting axis and which transmits this moment to the chute.

The document U.S. Pat. No. 3,766,868 proposes a device of the type described in the preamble in which a rod located in the pivoting plane of the chute is articulated with one end on the rear surface of the chute. The other end of this rod is guided in a sinusoidal guide path of the second rotor.

The document U.S. Pat. No. 3,814,403 proposes a device of the type described in the preamble in which the second rotor forms a gear ring coaxial with the vertical rotation axis. This gear ring drives, through a first pinion, an endless screw which acts, through a second pinion, on a toothed sector. The latter is fixed laterally on to a suspension bearing for the chute.

The document U.S. Pat. No. 4,368,813 proposes a device of the type described in the preamble in which the rotor also comprises a gear ring coaxial with the vertical rotation axis of the chute. This gear ring co-operates with an input gear, with vertical axis, of a connecting rod and crank mechanism supported by the first rotor. The connecting rod of this mechanism is contained in the pivoting plane of the chute and is articulated with its free end on the rear surface of the chute.

The document U.S. Pat. No. 4,941,792 proposes two implementations of a device of the type described in the preamble. In a first implementation, a pivoting lever supported by the first rotor is used so that it can pivot in the pivoting plane of the chute. This pivoting lever is connected through a rod with ball and socket joints to the second rotor. The chute comprises two lateral suspension bearings each fitted with a crank. A forked rod (a stirrup) connects the pivoting rod to the two cranks of the chute. In a second implementation the second rotor supports a toothed annular segment which co-operates with a toothed sector attached to a lateral suspension bearing of the chute.

The document U.S. Pat. No. 5,002,806 proposes a device of the type described in the preamble, in which the second rotor is connected to a crank which is attached to a lateral suspension bearing of the chute by means of a rod with ball and socket joints.

The document U.S. Pat. No. 5,022,806 proposes a device of the type described in the preamble, in which the chute comprises a lateral arm which slides in a guide channel with the help of an articulated foot on this arm. This guide channel is defined by a curved element supported by the second rotor. The centre of curvature of the curved element defining the guide channel is located at the point of intersection of the pivoting axis and the rotation axis of the chute.

In general, it is important to note that the moment which has to be transmitted to the chute in order to pivot it about its horizontal pivoting axis may become very large, particularly if the chute is of very massive construction (as is the case, for example, on a blast furnace), and/or if the amplitude of pivoting is large. It follows that large forces have to be transmitted by the pivoting mechanism connecting the second rotor to the chute.

The object of the present invention is to improve, in a device of the type described in the preamble, the transmission of the forces between the second rotor and the chute.

According to the present invention %this objective is attained by a device for the distribution of materials in bulk comprising

- a chute for the delivery of materials in bulk,
- a first rotor with a substantially vertical rotation axis, the chute being suspended from the said first rotor so as to be driven in rotation by this rotor and so as to be able to pivot about a substantially horizontal pivoting axis,
- a second rotor with a rotation axis substantially coaxial with the said first rotor,
- a pivoting ring connected to the chute at two locations diametrically opposite each other with respect to the pivoting axis of the chute so that said pivot ring (38) is pivotable about an axis perpendicular to the pivoting axis of the chute, and
- a guide means which is supported by the second rotor and which is in contact with the pivoting ring at no less than three points so as to define for the said pivoting ring, in a coordinates system attached to the second rotor, an inclined plane of rotation which makes an angle $\alpha$ with a horizontal reference plane.

The pivoting ring creates, during a relative rotation in the rotation plane defined by the said guide means of the second rotor, a pivoting of the chute around the horizontal pivoting axis of the latter. In effect, when the two rotors are in rotation with respect to each other, the guide means forces the pivoting ring, which is equipped with a cardan mount type of suspension, to move around strictly in an inclined rotation plane defined in a coordinates system attached to the second rotor. This guide means thus imposes on the suspension axis of the pivoting ring an inclination varying between $-\alpha$ and $+\alpha$ in a coordinates system attached to the first rotor; this produces a variation in the angle of inclination of the chute in its pivoting plane. It is in particular pointed out that, by progressively increasing the angular offset between the two rotors from 0° to 360°, the proposed device produces a pivoting of the chute having an angular amplitude of $2\alpha$ in the pivoting plane of the chute, prior to returning the chute into its initial position.

In the first place, it will be appreciated that the means used to produce this pivoting of the chute in its pivoting plane with amplitude $2\alpha$ and a cycle of 360°, are in principle very simple.

From the viewpoint of the transmission of forces, it should first be noted that the chute produces a moment about its pivoting axis. This moment, which will be called the "pivoting moment" of the chute, is proportional to the weight of the chute and to the horizontal distance separating its centre of gravity from the vertical plane containing its pivoting axis. This distance is, of course, a function of the angle of inclination of the chute in its pivoting plane.

The pivoting moment of the chute should be completely taken up by the second rotor. For this purpose, the guide means of the second rotor defines in the said inclined rotation plane at least three points of contact with the pivoting ring. It is the reactions at these points of contact which are opposed to the said pivoting moment of the chute.

The pivoting ring constitutes a simple but ingenious component for optimally taking up, around the chute, the reactions of the said guide means and thus for opposing a moment in reaction to the said pivoting moment of the chute. In this connection, it will be appreciated that the number of points of contact between the pivoting ring and the chute may be greater than three. Of course, these points of contact may also be areas of contact. In addition, the distribution of these points of contact around the chute may be random, as long as the kinetic constraint in relation to the said inclined rotation plane is satisfied. Consequently, many possibilities are available for optimising the said points of contact, particularly in terms of the contact pressures which must be transmitted. In conclusion, the pivoting ring defines an ideal interface between the chute on the one hand and the second rotor on the other, in order to take up the said pivoting moment of the chute with the second rotor.

As regards the transmission of forces, it should also be noted that the pivoting ring, in the device according to the invention, involves a particularly long lever arm in taking up the said pivoting moment of the chute. This naturally has a beneficial effect on the magnitude of the forces to be transmitted in the device.

It should be noted that the said guide means may for example comprise isolated supports spaced around the circumference of the second rotor. Such supports then cooperate with a bearing surface of the pivoting ring so as to define the said inclined rotation plane in a reference frame attached to the second rotor. Such isolated supports comprise for example pad or plate supports.

The said guide means may however also comprise supporting surfaces which cooperate with isolated supports (pads or plates for example) or with corresponding supporting surfaces of the pivoting ring.

It should also be noted that the said guide means of the second rotor and the points of contact of the pivoting ring associated with it are preferably designed in such a way as to transmit forces in a direction perpendicular to the inclined plane of rotation in two opposite directions. This is, for example, the case if two supporting surfaces are positioned in such a way as to define a guiding groove for the elements in relative rotation in this groove.

In a preferred implementation, the said guide means comprises a large diameter suspension bearing. The latter comprises two rings which can rotate with respect to each other while being capable of transmitting axial forces in two directions and tilting moments. The first of these rings is attached to the pivoting ring of the chute, and the second of these rings is attached to the second rotor in such a way as to define the said angle $\alpha$ for the said inclined plane of rotation of the pivoting ring. This method of implementation produces an almost optimum distribution of the forces transmitted between the second rotor and the pivoting ring, while ensuring minimum friction and wear. In addition, it should be noted that the rolling elements positioned between the two bearing rings may be likened to multiple supports, which are distributed circumferentially around the chute and all actively contribute to the transmission in two directions of forces perpendicular to the said inclined plane of rotation. It will be appreciated from this that all the rolling elements of the bearing participate in taking up the said pivoting moment of the chute. Another advantage of this implementation lies in the fact that the bearing can more easily be protected against soiling by dust or smoke than can isolated supporting pads or plates and their associated bearing surfaces.

The chute is advantageously fixed, in a rigid but demountable way, to a supporting plate having a central opening for the passage of the material to be distributed by the chute. This supporting plate is then connected to the pivoting ring using a first pair of pivots so as to define the suspension axis about which the pivoting ring may pivot, and to the first rotor using a second pair of pivots so as to define the pivoting axis of the chute. This is a simple method of suspending the chute, which permits an excellent transmission of the said pivoting moment of the pivoting ring to the chute. In addition, the supporting plate forms a kind of annular protective screen above the chute. Finally, the chute may be dismantled without needing to dismantle its suspension and that of the pivoting ring.

The said first rotor and the said second rotor are advantageously suspended in an outer casing which may be mounted in a sealed manner on an enclosed space, a shaft furnace for example. A central feed channel then emerges in a sealed manner into the outer casing and passes axially through the said first and the said second rotors and the said central opening in the supporting plate of the chute.

In order to reduce penetration of dust, smoke, hot gases, etc., into the outer casing of the device according to the invention, several means of isolation and/or compartmentalisation of the device may advantageously be provided.

Thus, the pivoting ring advantageously supports an isolating jacket, which is coaxial with the axis of rotation and which defines an annular air joint or gap with an annular area of the outer casing.

In addition, the central feed channel is advantageously fitted with a spherical collar which co-operates with the central opening in the supporting plate in which it is positioned, so as to define in the latter an annular air joint or gap.

Finally, the supporting plate is advantageously a disc bounded by a spherical ring which co-operates with a central opening in the pivoting ring in which it is positioned so as to define an annular joint in it.

It should be noted that the effectiveness of these measures of isolation and compartmentalisation is greatly improved if the outer casing is connected to a source of gas in order to pressurise it.

As regards the geometrical design of the device according to the invention, it should be noted that the chute advantageously makes, in its pivoting plane, with the axis about which the pivoting ring may pivot, an angle $\beta$ such that $\beta=90°-\alpha$. In this way, the chute pivots between a position in which it is vertical and a maximum angle of inclination of $2\alpha$ with respect to the vertical.

Other special features and characteristics of the present invention will emerge from the detailed description of a preferred embodiment using the appended figures in which:

FIG. 1 represents a cross-section through a device for the distribution of materials in bulk according to the invention. In the embodiment described below solely as an illustration, it is for example a device for charging a shaft furnace, particularly a blast furnace.

Figure 1:
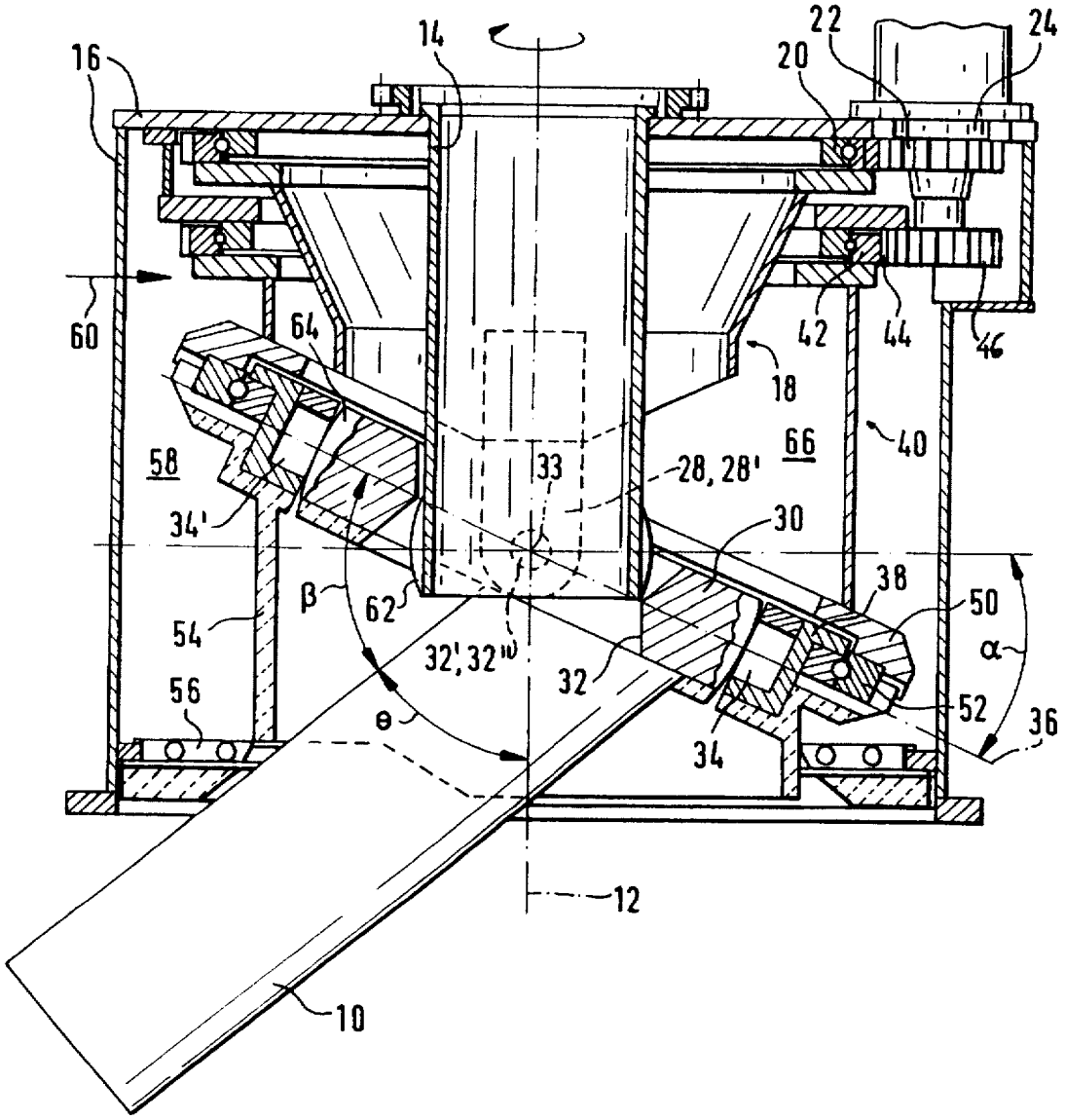
FIG. 1 represents a cross-section through a device for the distribution of materials in bulk according to the invention.

This device comprises a chute 10 which can rotate around a substantially vertical axis 12 and whose inclination can be varied during its rotation. In other words, the angle of inclination θ of the chute with respect to the vertical can be varied while the chute is rotating about the axis 12.

The reference number 14 indicates a feed channel into which the materials in bulk are poured in order to be distributed by the chute 10. This feed channel 14 is supported by an outer casing 16. In order to fix ideas, it will be assumed that the casing 16 is supported in a sealed manner on a shaft furnace, and that the feed channel 14 is connected in a sealed manner to a hopper serving as a batch feeder upstream from the distribution or charging device (the shaft furnace and the batch hopper are not represented in the figures). The charging material flowing from the batch hopper then passes through the feed channel 14 so as to fall on to the chute 10 and to be guided by the chute towards the surface of the charge in the shaft furnace. The point of impact of the charging material on the surface of the charge is varied by rotating the chute around the rotation axis 12 and/or by varying its angle of inclination θ.

In order to permit the rotation of the chute around the axis 12, it is suspended from a first rotor 18, which forms a kind of rotating cage suspended with the help of a first suspension bearing 20 in the casing 16. It can be seen that the suspension bearing 20 is a large diameter bearing surrounding the feed channel 14. A gear ring 22, which is attached to the first rotor 18 and is coaxial with the axis 12, is driven by a pinion 24. This pinion 24 makes it possible to confer on the first rotor 18 a rotational motion of speed Ω about the axis 12. It should be noted that the rotor 18 surrounds the feed channel 14 and is equipped at its lower part with two suspension brackets 28 and 28' to support the chute 10.

The chute 10 is preferably fixed rigidly, but in an easily detachable manner, on a supporting plate 30, which has a central opening 32 for the passage of the feed channel 14. This supporting plate 30 is then connected to the suspension brackets 28 by means of a pair of pivots 32' and 32" in such a way as to define a pivoting axis 33 for the chute 10. Preferably, this pivoting axis 33 is horizontal, and therefore perpendicular to the rotation axis 12. In FIG. 1, this pivoting axis 33 is perpendicular to the plane of the drawing.

A pivoting ring 38, which creates the pivoting of the chute 10, is mechanically connected to the supporting plate 30 by means of a second pair of pivots or bearings 34 and 34'. The latter are located in the pivoting plane of the chute at two points which are diametrically opposite with respect to the pivoting axis 33 of the chute 10. They define a pivoting axis 36 for the pivoting ring 38 which is perpendicular to and coplanar with the pivoting axis 33 of the chute 10 and which makes an angle β with the chute 10 in the pivoting plane of the latter. It should be noted that the pivoting ring could now: (1) pivot about the axis 36; (2) pivot about the axis 33; (3) rotate about the axis 12. In other words, the pivoting ring 38 is equipped with a suspension of the cardan mount type in rotation about the axis 12. However, it will be seen below that some of these movements are limited by the guide means supported by a second rotor which is denoted overall by the reference number 40.

The second rotor 40 is suspended and driven in a way similar to that described for the first rotor 18. This second rotor in fact comprises a large diameter suspension bearing 42 and a gear ring 44. This gear ring 44 is driven by a second pinion 46 so as to give the second rotor 40 a rotational motion of speed Ω2 about the axis 12. It should be noted that Ω1 and Ω2 are preferably capable of being varied independently of each other.

The second rotor 40 is suspended from the bearing 42 and surrounds the first rotor 18. It is equipped with an annular supporting bracket 50 in an inclined plane s making an angle α with a horizontal reference plane. It should be noted in FIG. 1 that the said inclined plane is perpendicular to the plane of the drawing.

A third large diameter suspension bearing 52 is mounted with one of its two rings (e.g. with its outer ring) on this supporting bracket 50. The other bearing ring 52 (in FIG. 1 it is the inner ring) is, on the other hand, fixed to the pivoting ring 38. It should be noted that the two rings of this bearing 52 are capable of rotating with respect to each other while being able to transmit quite large axial forces and tilting moments in both directions. In this way, the bearing 52 guides the pivoting ring 38 in a plane of rotation which makes an angle α with a horizontal reference plane. In the device represented in FIG. 1, this angle α is about 25°.

Figure 3:
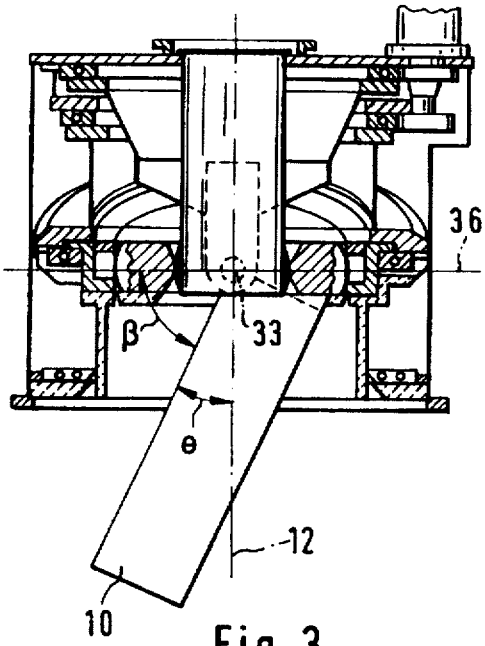
Figure 4:
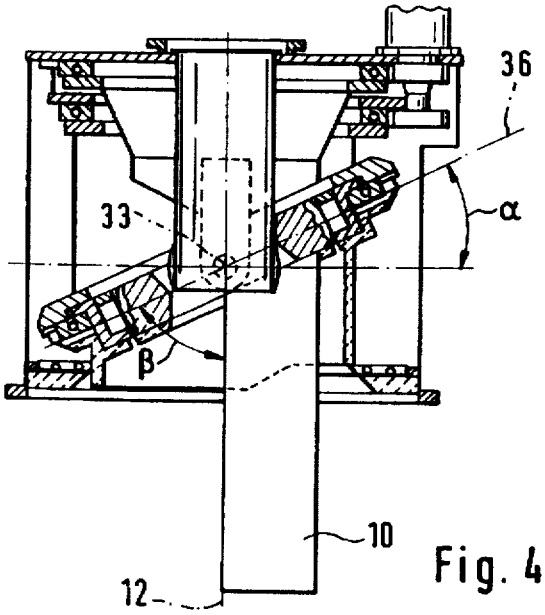

Before describing other structural details of the device in FIG. 1, its operation will first be described using FIGS. 2 to 4.

Figure 2:
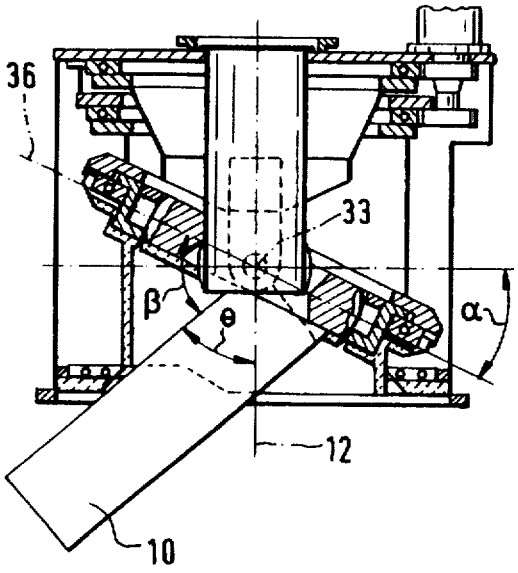
FIGS. 2 to 4 represent the device of FIG. 1 for different inclined positions of the chute.

FIG. 2 is in general the same as FIG. 1. It can be seen that the chute makes an angle θ of about 50° with the axis 12. For the device represented this is the maximum angle of inclination. This angle of inclination θ of the chute will remain constant as long as the first rotor 18 and the second rotor 40 rotate at the same speed; i.e. as long as no angular offset occurs between the two rotors 14 and 18.

On the other hand, in order to reduce the angle of inclination θ of the chute 10, it is enough to produce an angular offset between the first rotor 18 and the second rotor 40. In FIG. 3, this angular offset is 90° compared with FIG. 2. It can be seen that θ is now 25°. In fact, the axis 36 of the pivoting ring 38 is now horizontal, which means that $\theta=90°-\beta$.

In order to reduce the angle of inclination θ further, it is necessary to increase further the angular offset between the two rotors 18 and 40. In FIG. 4, this angular offset is 180° compared with the situation in FIG. 1. It can be seen that θ is now 0°, i.e. that the chute is vertical. It should be noted that this vertical position is obtained by choosing the angle β such that $\beta=90°-\alpha$. It should also be noted that the angle α is determined in such a way that $\alpha=\theta\ max/2$, where θ max is the amplitude of pivoting required for the chute. In the particular case when $\beta=90°-\alpha$, this amplitude of pivoting max is of course also the maximum inclination of the chute with respect to the rotation axis 12.

By increasing the angular offset between the two rotors to more than 180°, the angle of inclination θ of the chute 10 increases once again. For an angular offset of 270°, the chute occupies the position shown in FIG. 3 and for an angular offset of 360° the chute 10 takes up the position shown in FIG. 2.

It follows that, if the first rotor 18 is stopped and the second rotor 40 is made to rotate, the chute pivots in its pivoting plane (not rotating) through an angle of 2α at a frequency Ω2/60, where Ω2 is the speed of rotation in revolutions per minute of the second rotor 40. Similarly, if the second rotor 40 is stopped and the first rotor 18 is made to rotate, the chute pivots in a pivoting plane (this time rotating with the first rotor 18) through an angle of 2α at a frequency Ω1/60 where Ω1 is the speed of rotation in revolutions per minute of the first rotor 18. If both rotors 18 and 40 are made to rotate at the same speed, i.e. if $\Omega 1=\Omega 2$, the angle of inclination of the chute 10 does not change. If, on the other hand, a difference in speed is imposed on the two rotors 18 and 40, a variation in the angular offset between the two rotors 18 and 40 is produced, which causes the angle of inclination $\theta$ of the chute 10 to change.

If the difference between the speeds of rotation $\Omega 1$ and $\Omega 2$ is always of the same sign (i.e. either positive or negative), the angular offset between the two rotors 18 and 40 increases regularly and the chute 10 performs a periodic pivoting movement between its maximum position of inclination ($\theta$ max) and its minimum position of inclination ($\theta$ min).

It should be noted that, most frequently, the chute is balanced in such a way that its pivoting moment is a maximum when $\theta=\theta$ max. In this context, it should be pointed out that, even if the difference between the speeds of rotation $\Omega 1$ and $\Omega 2$ is constant, the angular speed with which the angular inclination $\alpha$ of the chute varies has a sinusoidal variation. In particular, this angular speed is a maximum midway between $\theta$ max and $\theta$ min, it then decreases and becomes zero at $\theta$ max. It follows that the power absorbed by the two rotors 18 and 40 rotating at constant speed about the axis 12 does not increase in proportion to the said pivoting moment of the chute. This is naturally an advantage as regards the dimensioning of the means for driving the two rotors 18 and 40.

It should also be noted that there is absolutely no obligation to pass through the maximum and/or minimum positions of inclination $\theta$ max, $\theta$ min, which are mechanically possible. Instead, then, of using the periodicity of the pivoting movement when the angular offset between the two rotors 18 and 40 changes from 0° to 360°, this angular offset of the two rotors 18 and 40 is increased and decreased at will between two predefined values which correspond to the maximum and/or minimum inclination desired in practice. In other words, the relative speed of rotation of the two rotors 18 and 40 is varied periodically between a positive value and a negative value.

Other notable characteristics of the proposed device will be described by referring once again to FIG. 1. It can be seen that the pivoting ring 38 supports a cylindrical isolating jacket 54. This isolating jacket 54 is coaxial with the rotation axis 12 and, with an annular area 56 of the casing 16, forms an annular air joint (or gap). In this way, an annular space 58 in the outer casing 16 is defined, a space which can be kept at a slightly higher pressure by injecting a gas. The arrow 60 shows diagrammatically the means (ducting, for example) by which such a gas may be injected. This reduces the penetration of dust and smoke into this annular space 58 in which are located, in particular, the bearings 20, 42, 52, the gear rings 22, 44 and the pinions 24, 46. In addition, this injected gas may be used to cool the device. It should be noted that the isolating jacket 54 is advantageously equipped with thermal insulation, while the annular area 56 is advantageously cooled by a liquid coolant and, in the case of a blast furnace for example, is equipped with a protective coating against thermal radiation from the surface of the charge. Such protection against thermal radiation is also advantageously applied or fixed below the pivoting ring 38 and the supporting plate 30.

In order to provide still more protection for the device against penetration by smoke, fumes and dust, the feed channel 14 is equipped with a spherical collar 62 which is fitted in the central opening 32 of the supporting plate 30. This opening 32 comprises a contracted section in which the collar 62 defines an annular air joint (or gap). The supporting plate 30 is in addition advantageously a disc whose lateral surface 64 is a spherical ring which defines an annular air joint (or gap) in the pivoting ring 38. In general, however, the plate 30 could also be rectangular and be fitted into a rectangular opening of the ring of the pivoting ring 38. In this case, it would be enough for the two lateral edges parallel to the axis 36 to match the shape of a cylinder coaxial with the axis 36. With these additional isolating measures, an annular space 66 is created between the feed channel 14 and the rotor 40, a space which may be pressurised by the injection of a gas under pressure into the casing 16. Most frequently, the annular spaces 58 and 66 are in direct communication with each other so as to avoid pressure differences within the outer casing 16. Such pressure differences could in fact have a harmful effect on the efficiency of the annular air joints (or gaps) described above.

It will also be noted that the bearing 52 is advantageously incorporated in an annular cavity defined for example by the isolating jacket 54, the pivoting ring 38 and the annular flange 38 of the second rotor 40. In this way, the bearing 52 is protected to an even greater extent against excessive penetration of dust and direct contact with hot or corrosive gases.

When the proposed device has to equip a furnace operating at high temperature, the first and second rotors 18 and 40 are advantageously connected, using a rotating joint, to a cooling circuit (not represented). In this way, the principal mechanical elements which are attached either to the first or to the second rotor may be cooled efficiently.

We claim:

1. Device for the distribution of materials in bulk comprising:

a chute (10) for the delivery of materials in bulk, a first rotor (18) with a substantially vertical rotation axis (12), the chute (10) being suspended from the said first rotor (18) so as to be driven in rotation by this rotor and so as to be able to pivot about a substantially horizontal pivoting axis (33), a second rotor (40) with a rotation axis substantially coaxial with the said first rotor (18), a pivoting ring (38) connected to the chute (10) at two locations (34, 34') diametrically opposite each other with respect to the pivoting axis (33) of the chute (10) so that it can itself pivot about an axis (36) perpendicular to the horizontal pivoting axis (33) of the chute, and a guide means (52) which is supported by the second rotor (40) and which is in contact with the pivoting ring (38) at no less than three points so as to define for the said pivoting ring, in a coordinates system attached to the second rotor (40), an inclined plane of rotation which makes an angle $\alpha$ with a horizontal reference plane.

2. Device according to claim 1, wherein the said guide means comprises a large diameter suspension bearing (52) having two rings which can rotate with respect to each other, the first ring forming a rotating support for the pivoting ring (38) of the chute (10) and the second ring being attached to the said second rotor (40) in such a way as to define the said angle $\alpha$ for the said plane of rotation of the pivoting ring (38).

3. Device according to claim 1, wherein the chute (10) comprises a dismountable supporting plate (30) having a central opening (32) for the passage of the material to be distributed by the chute.

4. Device according to claim 3, wherein the pivoting ring (38) is connected to the supporting plate (30) using a pair of pivots (34, 34') so as to define the axis (36) about which the pivoting ring (38) may pivot.

5. Device according to claim 4, wherein the supporting plate (30) is connected to the first rotor (18) using a pair of pivots (32', 32") so as to define the pivoting axis (33) of the chute.

6. Device according to claim 3, wherein the said first rotor (18) and the said second rotor (40) are suspended in an outer casing (16) which may be mounted in a sealed manner on an enclosed space, and a feed channel (14) emerges in a sealed manner into the outer casing (16) and passes axially through the said first and the said second rotors (18 and 40) and the said central opening (32) in the supporting plate (30).

7. Device according to claim 6, wherein the pivoting ring (38) supports an isolating jacket (54) which is cylindrical and coaxial with the axis of rotation (12) and which, with an annular area (56) of the outer casing (16) defines an annular air joint.

8. Device according to claim 6, wherein the feed channel (14) is fitted with a spherical collar (62) which co-operates with the central opening (32) of the supporting plate (30) so as to define in the latter an annular air joint.

9. Device according to claim 6, wherein the supporting plate (30) is a disc bounded by a spherical ring (64) which co-operates with a central opening of the pivoting ring (38) so as to define an annular air joint in it.

10. Device according to claim 6, wherein the outer casing (16) is connected to a source of gas (60).

11. Device according to claim 1, wherein the chute (10) makes, with the axis (36) about which the pivoting ring (38) may pivot, an angle $\beta$ such that $\beta=90°-\alpha$.

* * * * *